US009463467B2

(12) United States Patent
Hoffmann

(10) Patent No.: US 9,463,467 B2
(45) Date of Patent: Oct. 11, 2016

(54) PROCESS AND DEVICE FOR SUPPORTING AND DISPLACING A SEMIMOBILE CRUSHER PLANT

(71) Applicant: TAKRAF GmbH, Leipzig (DE)

(72) Inventor: Dieter Hoffmann, Leipzig (DE)

(73) Assignee: TAKRAF GmbH, Leipzig (DE)

( * ) Notice: Subject to any disclaimer, the term of this patent is extended or adjusted under 35 U.S.C. 154(b) by 150 days.

(21) Appl. No.: 14/195,121

(22) Filed: Mar. 3, 2014

(65) Prior Publication Data

US 2015/0246356 A1 Sep. 3, 2015

(51) Int. Cl.
*B02C 21/02* (2006.01)

(52) U.S. Cl.
CPC ..... *B02C 21/026* (2013.01); *Y10T 29/49* (2015.01); *Y10T 29/49963* (2015.01)

(58) Field of Classification Search
CPC ..... B02C 21/02; B02C 21/026; B27L 11/00; B27L 11/002; B27L 11/02; B27L 11/06; A01G 23/095; A01G 23/02; A01G 23/06; A01G 23/08; A01G 23/093; E21B 4/18; Y10T 29/49; Y10T 29/49963
USPC ..... 299/31; 241/101.74, 101.71, 101.741, 241/101.742
See application file for complete search history.

(56) References Cited

U.S. PATENT DOCUMENTS

| | | | | |
|---|---|---|---|---|
| 3,911,980 | A * | 10/1975 | McColl | A01G 23/08 144/24.13 |
| 3,924,876 | A | 12/1975 | Vaillant et al. | |
| 4,763,845 | A | 8/1988 | Guggenheimer et al. | |
| 4,951,885 | A | 8/1990 | Thüs | |
| 7,588,204 | B2 | 9/2009 | Douglas et al. | |
| 8,695,904 | B2 * | 4/2014 | Davis | B02C 23/02 241/101.74 |
| 2011/0174907 | A1 | 7/2011 | Davis et al. | |

FOREIGN PATENT DOCUMENTS

| | | |
|---|---|---|
| DE | 23 57 364 A | 5/1974 |
| DE | 36 15 118 A1 | 10/1987 |
| DE | 37 36 966 C2 | 9/1989 |
| DE | 296 23 367 U1 | 3/1998 |

OTHER PUBLICATIONS

Australian Office Action of May 12, 2015.

* cited by examiner

*Primary Examiner* — Mark Rosenbaum
(74) *Attorney, Agent, or Firm* — McGlew and Tuttle, P.C.

(57) ABSTRACT

A semimobile crusher plant as well as a process for displacing and supporting a semimobile crusher plant are disclosed. The semimobile crusher plant is permanently connected to a crawler-type chassis that has double crawlers, on which the entire load of the crusher plant rests during the displacing. During the crusher operation, the entire load of the crusher plant, including a payload, is supported by means of support rockers more or less equally on the double crawlers of the crawler-type chassis and on foundation blocks provided at the operating sites of the crusher.

17 Claims, 1 Drawing Sheet

PROCESS AND DEVICE FOR SUPPORTING AND DISPLACING A SEMIMOBILE CRUSHER PLANT

FIELD OF THE INVENTION

The present invention pertains to a process for supporting and displacing a semimobile crusher plant as well as to a semimobile crusher plant.

BACKGROUND OF THE INVENTION

Crusher plants known from the state of the art are usually used in a stationary manner and are only mobile insofar as they can be passively displaced. Such a crusher unit of a portable crusher plant is known from DE 37 36 966 C2. The crusher unit here has a portal-like frame, which is supported via pontoons on a load-bearing natural ground or via support feet on concrete foundations. The crusher unit cannot be actively transported, but can be relocated by means of suitable apparatus, e.g., a transport crawler—transport with crawler traveling gear (continuous track or crawler track vehicle propulsion).

Such a transport crawler is described in the printed publication DE 296 23 367 U1. For displacing a crusher plant, the crawler with its two-crawler-type chassis is driven under the portal and its elevating platform is connected to the portal. The crusher plant is elevated via a suitable hydraulic system arranged at the crawler and transported in this position. Because of the high weight of up to 2,000 t of usual crusher plants, these must always be kept in a horizontal position when traveling on a level surface but also on inclines in order to load the transport crawler centrally and to rule out a tipping over of the crusher plant with a high center of gravity. If the new location is reached, the crusher plant is set down and the transport crawler is driven away.

Because of the great weight of crusher plants crawlers suitable for their transport are complicated and expensive. Therefore, they are preferably leased and supplied each time for displacing a crusher plant. In addition, the transport of the crusher makes it necessary to remove the dischargers arranged separately in the portal. For reasons of weight, other components are also frequently removed and transported separately. This manner of displacing is complicated and takes up several days, which results in a high loss of production during the crushing of excavated material.

SUMMARY OF THE INVENTION

The object of the present invention is to overcome the drawbacks of the state of the art and suggest a crusher plant, which can be relocated in a short time and nevertheless has a high operating safety during crushing. During displacing, the entire crusher plant shall be able to be transported safely without major disassemblies even over open pit mining ramps.

This object is accomplished by a semimobile crusher plant according to the main claim as well as a process for supporting and displacing this crusher plant according to claim 7. Variants of the present invention are preferably the subjects of the related subclaims.

According to the present invention, the object is accomplished by a crusher plant, to whose lower supporting structure both crawler-type chassis and support rockers are permanently fastened, whereby the load of the crusher plant is completely borne by the crawler-type chassis when relocating. At the operating site, the load of the crusher plant, including a major payload, is borne more or less equally by the crawlers as well as the support rockers.

The semimobile crusher plant according to the present invention has a supporting frame, in which are arranged a receiving bunker for material dumped by trucks, a crusher, an intermediate bunker for the crushed material as well as a discharge belt. A crawler-type chassis consisting of three double crawlers is permanently arranged under the supporting frame. In a preferred embodiment of the present invention, the six-crawler-type chassis consists of two rear double crawlers that are mounted at the supporting frame in a noncontrollable manner, as well as a front, controllable double crawler.

The single crawlers are connected to one another by pendulum axles and carrying cases, whereby the pendulum axles make possible a transverse pendular motion of the crawlers to one another as well as to the lower supporting structure. The carrying cases are connected via longitudinal axles to the support rockers, which are fastened via major axles to the supporting frame of the crusher plant. In this case, the pendulum axles and the longitudinal axles in pairs form cross joints. The rockers, which are preferably mounted rotatably by means of axles, support the entire load of the crusher plant in a first position via the cross joints on the pairs of crawlers. In this first position, the support rockers lie against a stop, as a result of which the rotatability is blocked. A movement of the support rockers with a weight displacement connected therewith is consequently eliminated.

On the other hand, during a crusher operation, the support rockers are mounted rotatably about the axles. Consequently, half of the load is set down onto the crawlers and half of the load is set down on specially shaped foundation blocks. The support feet of the support rockers here have sloping surfaces directed downwards and provided with flanges. These bring about a rotary movement of the support rockers about the major axles from the first into the second position during the sliding on sloping surfaces, directed upwards, of the foundations arranged at the respective operating sites.

Furthermore, the subject of the present invention is a process for displacing and supporting a semimobile crusher plant. Here, the crusher plant is borne completely by the crawler-type chassis during the displacing. The support rockers of the crusher plant lie against the underside of the supporting frame during the displacing and support the entire load of the crusher plant via cross joints on the crawler-type chassis. Foundations, which correspond in their arrangement and size with the double crawlers as well as support rockers located at the supporting frame of the crusher plant, are provided at the operating positions of the crusher plant. The foundations have, in the direction of approach of the crusher plant, surfaces that are rising diagonally and are provided with flanges.

During the descending of the crusher plant, the sloping support surfaces of the support feet arranged at the support rockers slide onto the sloping foundation blocks. Due to a slight rotation of the support rockers brought about thereby, up to 50% of the load of the crusher plant is supported on concrete foundations. If the support rockers have reached their end position, the crusher plant is preferably connected to the flanges of the foundations via the flanges arranged at the support feet and thus further increases the operating safety.

The object according to the present invention is thus accomplished by the crusher plant being displaced via three double crawlers, and the additional support at the operating site taking place via rockers, whose one side places the load in each case onto the set of crawlers and whose other side places the load in each case via support feet onto the concrete foundation. The crusher plant is supported only on the crawler-type chassis during the displacing and partly on the crawler-type chassis and partly on support feet during the crusher operation. To avoid large and complicated hydraulic cylinders, the rockers are designed, such that they guide the entire load onto the sets of crawlers during the displacing of the crusher plant and slide, during the descending into the operating position, only by the traveling motion, on the side opposite the crawlers onto the sloping surfaces of trestles, which are embedded in concrete foundations.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
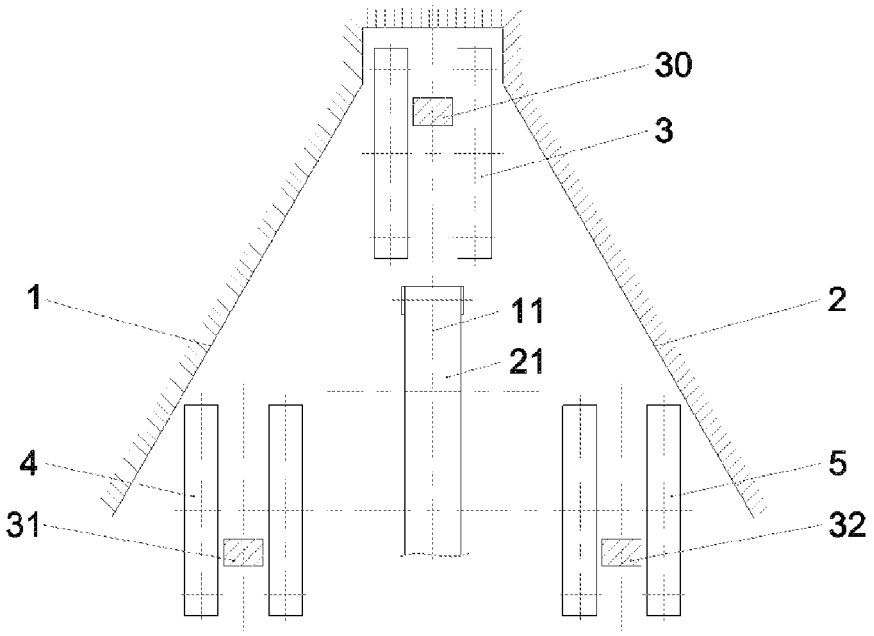
FIG. 1 is a schematic in a top view showing a six-crawler-type chassis of a semimobile crusher plant, including the support walls for two truck ramps.

For the feeding of material to be crushed by means of trucks the semimobile crusher plant in FIG. 1 is in operating position in a notch, whose walls are predetermined by the receiving bunker and the two truck ramps 1, 2. Since it is advantageous for the stability of the approximately 20-m high walls that the truck ramps 1, 2 form an angle of 60° with respect to each other, a trapezoidal notch forms, into which a six-crawler-type chassis with a three-point support is optimally inserted. This chassis has a great support distance and does not require any leveling even during traveling. It leaves the center under the crusher free for the discharge belt 21 with receiving hopper and has a high load capacity, such that no components have to be removed during the displacing of the crusher plant.

The six-crawler-type chassis consists of two rear, non-controllable double crawlers 4, 5 and a front double crawler 3 controllable via a pair of cylinders, not shown in the drawing. The double crawlers 3, 4 and 5 are also designated below as pairs of crawlers 3, 4 and 5. Because of the crawler control, the chain mechanisms and driving powers are small, such that standard gears, known for the drives of construction machines, can be used.

Figure 2:
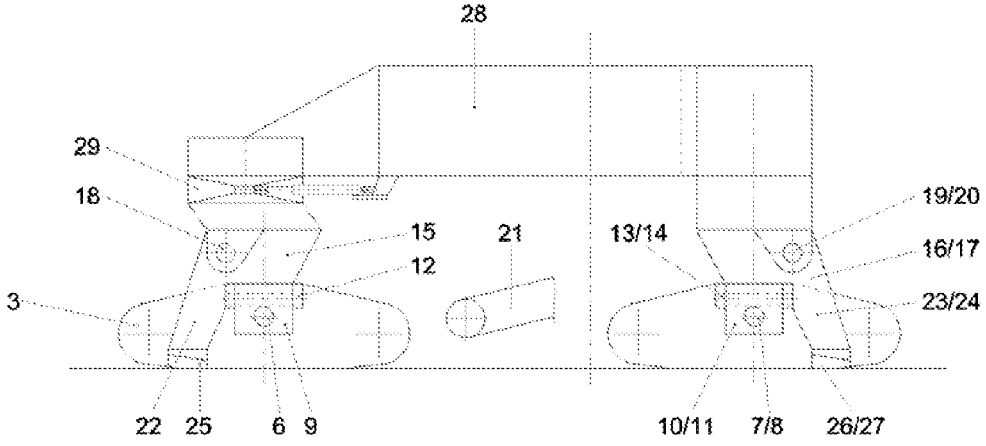
FIG. 2 is a schematic in a side view showing the crawler-type chassis of the semimobile crusher plant according to FIG. 1 with the lower supporting structure in a side view.

Each single crawler of the pairs of crawlers 3, 4 and 5 has two four-wheel bogies and four two-wheel bogies, which uniformly distribute the load on eight bogie wheels. The single crawlers shown in FIG. 2 are each connected to each other by means of pendulum axles 6, 7 and 8 as well as carrying cases 9, 10 and 11. In this case, the pendulum axles 6, 7 and 8 make possible an independent transverse pendular movement of the single crawlers with respect to one another and opposite the lower supporting structure 28. The carrying cases 9, 10 and 11 are in turn connected to the support rockers 15, 16 and 17 via longitudinal axles 12, 13 and 14. This brings about an equal load distribution onto both crawlers of a pair of crawlers 3, 4 and 5. The pendulum axles 6, 7 and 8 and longitudinal axles 12, 13 and 14 form cross joints in pairs and make possible an independent transverse pendular movement against one another and opposite the lower supporting structure 28.

The support rockers 15, 16 and 17 are connected via major axles 18, 19 and 20 to the front pivoting frame 29 or the lower supporting structure 28. During the crusher operation, up to approximately 50% of the support loads are distributed onto the double crawlers 3, 4 and 5 on one hand as well as up to approximately 50% onto the support feet 22, 23 and 24 on the other hand The support of the support feet 22, 23 and 24 takes place via sloping surfaces with flanges, which rest on the foundation blocks 25, 26 and 27, which are also provided with flanges, and are bolted to same.

The support surfaces 30, 31 and 32 on the foundation blocks 25, 26 and 27 are shown in FIG. 1 as a top view. The bolted connections are detached for displacing the mobile crusher plant. The crusher plant then backs up slowly, whereby the support feet 22, 23 and 24 are lowered and the support rockers 15, 16 and 17 are rotated. After a small rotation, the support rockers 15, 16 and 17 come to a stop on opposite sides. The entire load is now borne by the pairs of crawlers 3, 4 and 5. When traveling into the new position, the sloping support surfaces 30, 31 and 32 opposite the double crawlers of the pairs of crawlers 3, 4 and 5 slide onto the sloping foundation blocks 25, 26 and 27. The stops of the support rockers 15, 16 and 17 are raised and again up to approximately 50% of the load lies on the foundation blocks 25, 26 and 27. The flanges are bolted to one another for the duration of the crusher operation.

While specific embodiments of the invention have been shown and described in detail to illustrate the application of the principles of the invention, it will be understood that the invention may be embodied otherwise without departing from such principles.

LIST OF REFERENCE NUMBERS

1 Truck ramp
2 Truck ramp
3 Pair of crawlers
4 Pair of crawlers
5 Pair of crawlers
6 Pendulum axle
7 Pendulum axle
8 Pendulum axle
9 Carrying case
10 Carrying case
11 Carrying case
12 Longitudinal axle
13 Longitudinal axle
14 Longitudinal axle
15 Support rocker
16 Support rocker
17 Support rocker
18 Major axle
20 Major axle
21 Major axle
21 Discharge belt
22 Support foot
23 Support foot
24 Support foot
25 Foundation block
26 Foundation block
27 Foundation block
28 Lower supporting structure

29 Pivoting frame
30 Support surface
31 Support surface
32 Support surface

What is claimed is:

1. A semimobile crusher plant comprising:

a supporting frame with receiving and intermediate bunkers;

a crusher;

a discharge belt;

a crawler chassis connected to the supporting frame, the crawler chassis having at least a pair of crawlers, each pair of crawlers comprising a double crawler; and a support rocker between the double crawler of each pair of crawlers, the support rocker having support feet on one side, the support rocker being supported, during crusher operation, via cross joints on the at least the pair of crawlers as well as via support feet on a respective foundation block, the support rocker being supported, during a displacing of the crusher plant, via the cross joints on the at least the pair of crawlers, wherein an entire load of the crusher plant can be supported on the at least the pair of crawlers and on the foundation blocks jointly during the crusher operation and only on the at least the pair of crawlers during the displacing.

2. A semimobile crusher plant in accordance with claim 1, wherein the support rocker is connected at a top via axles to a lower supporting structure or to a pivoting frame;

the support rocker is connected to the respective pair of crawlers on another side via longitudinal axles, pendulum axles and carrying cases;

the support rocker is joined to the lower supporting structure or the pivoting frame during the displacing; and the support rocker is detachably connected via the support feet to a respective foundation block at the respective operating site of the crusher plant, with the foundation block being provided for each of the double crawlers of a pair of crawlers and the foundation block having sloping rising surfaces with flanges in the direction of approach of the crusher plant.

3. A semimobile crusher plant in accordance with claim 1, wherein the crawler chassis is designed either as a six-crawler chassis or as a two-crawler chassis.

4. A semimobile crusher plant in accordance with claim 1, wherein the geometry of the support rocker and the respective foundation blocks is such that the crusher plant slides up alone due to the traveling motion with the support rockers onto the respective foundation blocks at the new operating site and slides down again for relocating again.

5. A semimobile crusher plant in accordance with claim 1, wherein the support feet and the respective foundation block are provided with flanges in the area of contact surfaces between the support feet and respective foundation block, which are bolted to one another in pairs during the crusher operation.

6. A semimobile crusher plant in accordance with claim 1, wherein the support rockers are moved onto said foundation blocks via a traveling motion of said crawlers.

7. A semimobile crusher plant in accordance with claim 1, wherein connections between the support feet and the foundation blocks are detached for displacing the crusher plant, wherein the crusher plant slides, due to the traveling motion of the double crawlers spontaneously with the support feet of the respective foundation blocks.

8. A process for displacing and supporting a semimobile crusher plant, the process comprising the steps of:

providing a semimobile crusher plant, comprising a supporting frame with receiving and intermediate bunkers, a crusher, a discharge belt, a crawler chassis connected to the supporting frame having at least a pair of crawlers, each of the pairs of crawlers comprising a double crawler; a support rocker between the double crawler of each pair of crawlers, the support rocker having feet on one side;

carrying the crusher plant completely by the at least the pairs of crawlers during the displacing, whereby the support rockers of the crusher plant lie against an underside of a lower supporting structure or of a pivoting frame in a stopped position; and bearing, during the crusher operation, the crusher plant approximately equally by the crawler chassis and the support feet, whereby the support feet of the crusher plant are detachably connected to a foundation block arranged at an operating position.

9. A process in accordance with claim 8, wherein the crusher plant slides onto foundation blocks spontaneously with the support feet due to the traveling motion of the double crawlers, and the support rockers rotate slightly out of the stopped position; and in an end position, the crusher plant is bolted by means of flanges between the support feet and the foundation blocks.

10. A process in accordance with claim 8, wherein:

for displacing the crusher plant, the connections between the support feet and the foundation blocks are detached again; and the crusher plant slides, due to the traveling motion of the double crawlers spontaneously with the support feet of the respective foundation blocks.

11. A semimobile crusher plant comprising:

a supporting frame with receiving and intermediate bunkers;

a crusher;

a discharge belt;

a crawler chassis connected to the supporting frame, the crawler chassis having at least a pair of crawlers, each pair of crawlers comprising a double crawler; and a support rocker between the double crawler of each pair of crawlers, the support rocker having support feet on one side, the support rocker being supported, during crusher operation, via cross joints on the at least the pair of crawlers and via support feet on a respective foundation block, the support rocker being supported, during displacement of the crusher plant, via the cross joints on the at least the pair of crawlers, wherein an entire load of the crusher plant is supported on the at least the pair of crawlers and on the foundation blocks jointly during the crusher operation and only on the at least the pair of crawlers during the displacing, the support rockers of the crusher plant engage an underside of a lower supporting structure or an underside of a pivoting frame during the displacement of the crusher plant.

12. A semimobile crusher plant in accordance with claim 11, wherein the support rockers are moved onto said foundation blocks via a traveling motion of said crawlers.

13. A semimobile crusher plant in accordance with claim 11, wherein connections between the support feet and the foundation blocks are detached for displacing the crusher plant, wherein the crusher plant slides, due to the traveling motion of the double crawlers spontaneously with the support feet of the respective foundation blocks.

14. A semimobile crusher plant in accordance with claim 11, wherein:

the support rocker is connected at a top via axles to a lower supporting structure or to a pivoting frame;

the support rocker is connected to the respective pair of crawlers on another side via longitudinal axles, pendulum axles and carrying cases;

the support rocker is joined to the lower supporting structure or the pivoting frame during the displacing; and the support rocker is detachably connected via the support feet to a respective foundation block at the respective operating site of the crusher plant, with the foundation block being provided for each of the double crawlers of a pair of crawlers and the foundation block having sloping rising surfaces with flanges in the direction of approach of the crusher plant.

15. A semimobile crusher plant in accordance with claim 11, wherein the crawler chassis comprises a six-crawler chassis or as a two-crawler chassis.

16. A semimobile crusher plant in accordance with claim 11, wherein the geometry of the support rocker and the respective foundation blocks is such that the crusher plant slides up alone due to the traveling motion with the support rockers onto the respective foundation blocks at the new operating site and slides down again for relocating again.

17. A semimobile crusher plant in accordance with claim 11, wherein the support feet and the respective foundation block are provided with flanges in the area of contact surfaces between the support feet and respective foundation block, which are bolted to one another in pairs during the crusher operation.

* * * * *